US005148619A

United States Patent [19]

Badali

[11] Patent Number: 5,148,619

[45] Date of Patent: Sep. 22, 1992

[54] LEVER ACTION FOR FIREARMS

[75] Inventor: Joseph A. Badali, Ogden, Utah

[73] Assignee: Browning

[21] Appl. No.: 798,693

[22] Filed: Nov. 26, 1991

[51] Int. Cl.[5] ..... F41C 7/06

[52] U.S. Cl. ..... 42/16; 42/20

[58] Field of Search ..... 42/16, 17, 18, 19, 20, 42/21, 22

[56] References Cited

U.S. PATENT DOCUMENTS

| | | | |
|---|---|---|---|
| 537,958 | 4/1895 | Ashton et al. | 42/18 |
| 1,322,438 | 11/1919 | Henderson | 42/18 |
| 3,377,731 | 4/1968 | Lawrence | 42/20 |
| 3,471,961 | 10/1969 | Lewis | 42/20 |

FOREIGN PATENT DOCUMENTS

| | | | |
|---|---|---|---|
| 70266 | 8/1893 | Fed. Rep. of Germany | 42/16 |
| 2218257 | 10/1973 | Fed. Rep. of Germany | 42/16 |

*Primary Examiner*—Stephen M. Johnson

[57] ABSTRACT

A rack and pinion system for a lever action firearm provides the rack element as a floating gear and includes a cam lever extension of the lever member. The cam lever extension applies rearward force directly to the bolt body and compresses a spring between the lever member and the rack element. After the bolt breaks free from the locking lugs, force is applied to the rack element by the lever member through the spring, whereby to complete the rearward movement of the bolt.

8 Claims, 3 Drawing Sheets

LEVER ACTION FOR FIREARMS

BACKGROUND

1. Field

This invention pertains to firearms, notably rifles. It is particularly directed to lever action firearms, and provides a lever linkage with better mechanical advantage than has been available in rack and pinion arrangements.

2. State of The Art

A number of firearm designs rely upon a bolt structure to urge cartridges into the chamber of the gun and to then lock into battery position to seal the chamber. The bolt typically includes a body portion and a bolt head portion configured to interact with stationary locking lugs. The bolt head is rotated either clockwise or counter clockwise selectively to lock the bolt into battery position or to unlock the bolt so that it may be moved away from the chamber. Rearward movement of the bolt (often called "breaking the bolt") causes rotation of the bolt head and usually activates other associated mechanisms of the firearm. These mechanisms may function to eject a spent cartridge, to retrieve a fresh cartridge from a magazine and to position the fresh cartridge for loading into the chamber by the bolt. Movement of the bolt rearward from its battery position also typically effects cocking of the firing mechanism of the firearm.

Firearm bolts have been operated by various means, including lever action linkages of different types. These linkages function to move the bolt to the rear, away from its battery position. Initial such movement rotates the bolt, thereby to disengage the bolt head from the locking lugs. Because of the large forces transmitted to these structures when the firearm is discharged, there is an inherent tendency for the bolt to bind at the lugs. Considerable rotational force is thus required to effect a disengagement.

A lever action includes a lever member pivotally connected to the frame of a firearm. An internal lever arm interacts with other components within the receiver portion of the firearm to, among other things, rotate and withdraw from battery position the bolt when the internal lever arm is actuated by movement of an oppositely extending external lever arm. For convenient and satisfying operation, it is desirable for the "stroke," that is, the travel required of the external lever arm to effect rotation and rearward travel of the bolt, to be "short," that is, involving a pivot motion of relatively few, typically less than about 100 degrees. Movement of the internal lever arm is inherently coordinated to movement of the external lever arm, thereby imposing a design constraint on the internal mechanical system driven by the lever member.

Rack and pinion systems are highly preferred for driving the bolts of commercially successful lever action firearms. The internal lever arm carries an integral rack element which drives a pinion gear, and the bolt caries an integral rack which is in turn driven by the pinion gear. The pinion gear may comprise a first stage or segment of relatively small diameter and a second stage of relatively large diameter. The first stage may be driven by the rack element carried by the internal lever arm. The second stage then drives the rack portion of the bolt. In this way, the travel of the bolt is amplified by the gear ratio of the two-stage pinion gear. This gear ratio inherently imposes a mechanical disadvantage on the system, however. That is, the pinion gear delivers a force of smaller magnitude to the bolt than that delivered to the pinion gear by the lever.

The rack and pinion system permits adequate bolt movement with a short lever stroke, but current arrangements provide insufficient rotational force to ensure reliable disengagement of the bolt head from the locking lugs, that is to "break the bolt," unless other steps are taken to relieve binding of the bolt head. The means generally employed is to relieve the contact surfaces between the bolt head and the locking lugs. A machined helical contact surface is typical of currently available rack and pinion lever action systems. Surface relief of this kind is detrimental to the accuracy achievable with a battery bolt firearm. Accordingly, lever action firearms are not generally as well regarded as bolt action firearms from the standpoint of accuracy. It is feasible to construct a conventional bolt action firearm with a flat contact surface between the locking lugs and the bolt head normal the axis of the bolt.

There remains a need for a rack and pinion system for a lever action firearm which will preserve the desirable features of current designs while providing sufficient rotational force to the bolt to avoid the necessity for relieving the contact surface between the locking lugs and the bolt head. Such a system would permit the construction of lever action firearms characterized by shooting accuracy approaching that of conventional bolt action designs.

SUMMARY OF THE INVENTION

This invention provides a floating gear system for a rack and pinion type lever action. The rack element normally carried by the inner lever arm of the lever member is provided as a floating rack gear. That is, it is pivotally pinned to the inner lever arm rather than forming an integral portion of the inner lever arm as is conventional. The initial force required to break the bolt is provided by a rigid cam extension which transmits force directly to the bolt body from the external lever arm. This improved lever linkage offers a much better mechanical advantage to effect the initial dislodgement of the bolt from the locking lugs, thereby avoiding any necessity for machined relief at the contact surface between the locking lugs and the bolt head.

The rack and pinion components of the system remain passive until after the bolt is "broken" by the force applied through the cam extension. Much less force is required to urge the bolt rearward following its initial dislodgement. The floating rack gear is biased by means which permit independent movement of the cam extension during the initial bolt breaking stage of a cocking sequence. Thereafter, the biasing means urges the floating rack gear into an interactive arrangement with the pinion gear to effect the bolt travel required to complete the cocking sequence.

BRIEF DESCRIPTION OF THE DRAWINGS

In the Drawings, which illustrate that which is presently regarded as the best mode for carrying out the invention.

DESCRIPTION OF THE ILLUSTRATED EMBODIMENT

Figure 1:
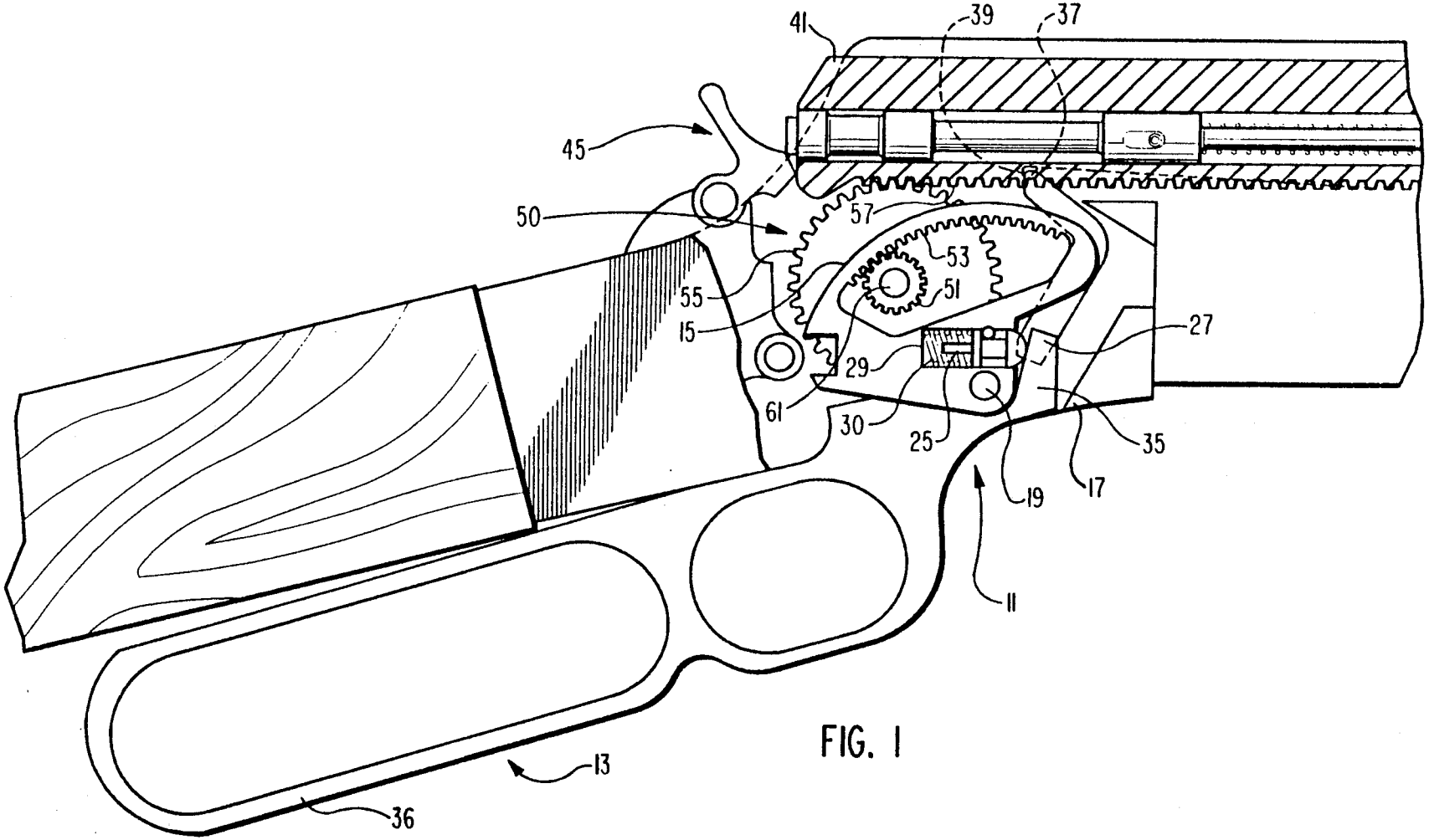
FIG. 1 is a schematic fragmentary illustration of a lever action assembly of this invention as it would be installed in a lever action rifle, the components of the assembly being shown positioned prior to the initiation of a cocking sequence.

An improved lever action assembly 11 of this invention, includes a lever member 13 and a spring biased floating rack element 15. The lever 13 and rack 15 are each pivotally connected to the frame 17 of the rifle by means of a common pin 19. A spring 25 is compressed between first and second reaction elements; namely a structural extension 27 of the lever member 13 and the bottom 29 of a bore 30 associated with the rack element 15. The spring 25 transmits force applied by the internal lever arm 35 to the rack 15, but is selected to compress at the initial, or bolt breaking, stage of travel of the external lever arm 36. As so arranged, the cam extension 37 of the internal lever arm 35 may travel independent of the rack element 15. In this fashion, force may be applied directly to the bolt body 41 by the cam extension 37.

Figure 2:
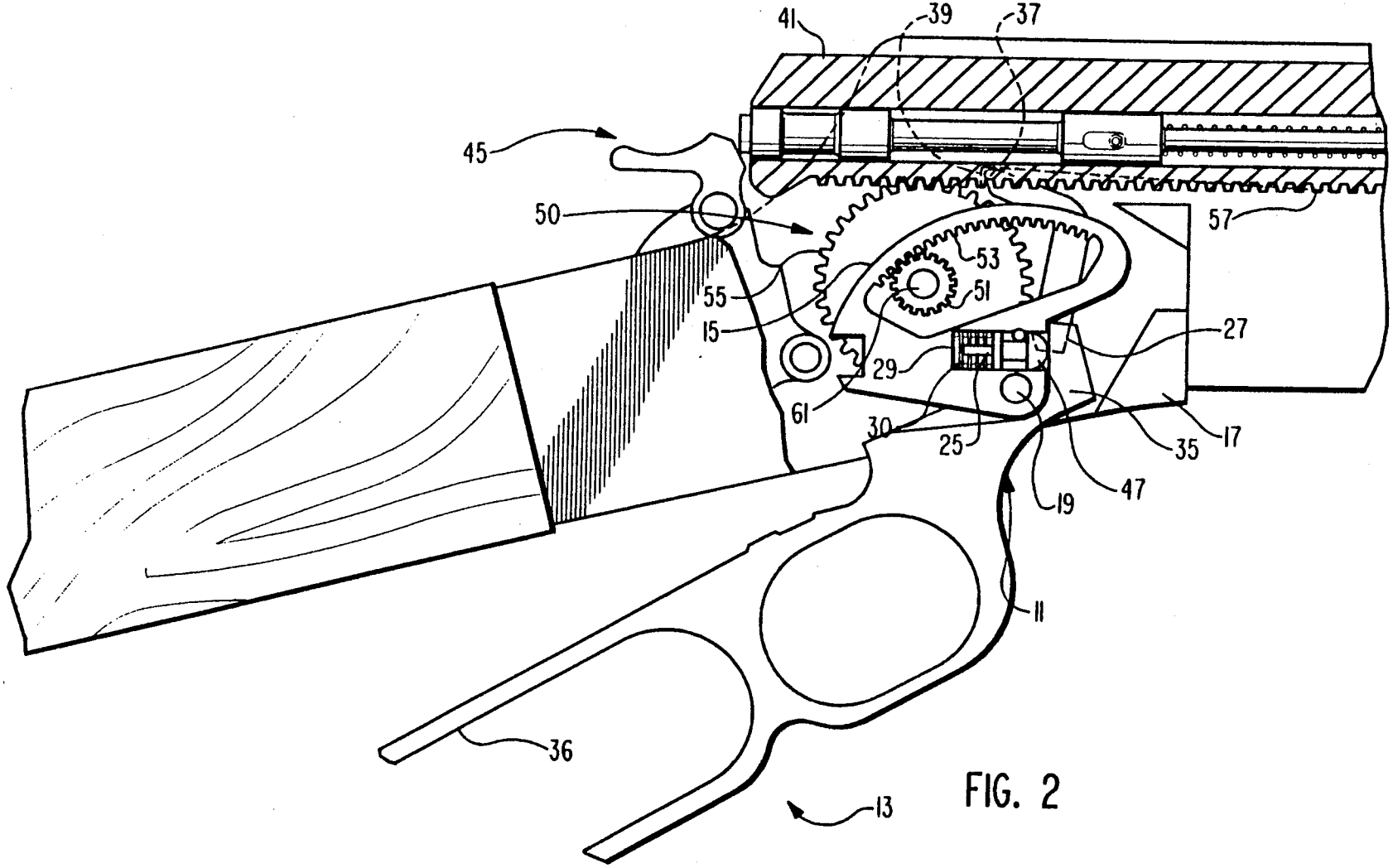
FIG. 2 is a similar schematic illustration showing the components of the assembly at the initial stages of a cocking sequence breaking the bolt.

As best shown by FIG. 2, the cam extension 37 operates against a surface 39 to push the bolt body 41 rearward past a hammer assembly, designated generally 45. Concurrently, the structure 27 forces a spring plunger 47 into the bore 30 against the spring 25 without effecting appreciable rotation of the floating rack 15 on the pin 19. In the illustrated instance, a mechanical advantage of approximately 3.5:1 is delivered through the lever 13 to the surface 39. The compressed spring 25 urges the rack element 15 to pivot in a selected (as illustrated, counter clockwise,) direction with respect to the lever member 13. The spring 25 stores energy until the bolt is broken, after which the spring is capable of overcoming the inertia of the rack element 15 and the bolt body 41.

Each of the figures illustrates a two-stage pinion gear 50 with a first stage 51 interacting with a rack surface 53 of the floating rack gear 15. This first stage 51 is integral with a second stage 55 of larger diameter positioned to interact with a rack surface 57 of the bolt body 41. After the bolt body 41 is broken free to initiate its rearward travel (FIG. 2), the spring 25 operates to effect a counterclockwise rotation of the floating rack gear 15 about the pin 19 into approximately the position shown by FIGS. 1 and 3. The initial travel of the bolt body 41 may be very rapid at this stage of the cocking sequence due to the recovery of the spring 25 from its compressed condition.

Figure 3:
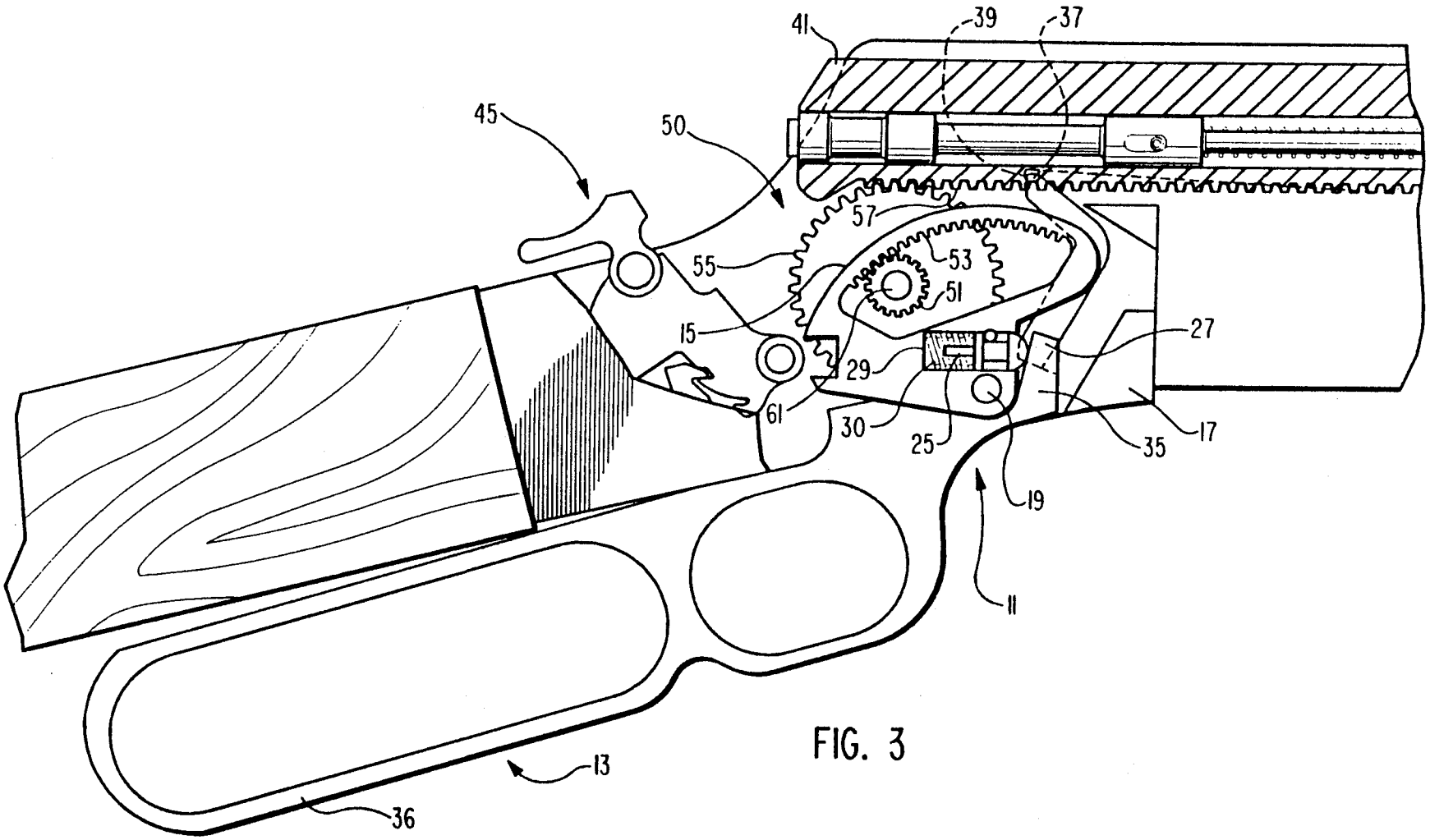
FIG. 3 is a similar schematic illustration showing the components of the assembly following the completion of a cocking sequence.

Further cocking action, that is, forward pivoting, of the lever arm 36, causes additional counter clockwise rotation of the floating rack gear 15, which turns the pinion gear 50 on its axle 61. The axle 61 is approximately parallel the pivot axis 19. As a consequence, the second stage 55 of the pinion gear 50 drives the bolt body 41 rearward to cock the hammer assembly 45 as best shown by FIG. 3. Once the spring 25 has come into equilibrium with the other components of the assembly, travel of the bolt body 41 is similar to that of other short stroke lever action firearms. Relatively little force is required to complete the cocking sequence, and only minor compression is experienced by the spring 25 once the bolt body 41 commences its rearward travel.

Reference in this disclosure to details of the illustrated embodiments is not intended to limit the scope of the appended claims which are intended to define the invention including equivalents.

What is claimed is:

1. In a lever action firearm of the type in which a pivoted lever member transmits force to a bolt body through a rack and pinion system, whereby to move the bolt body rearward to cock the firearm, the improvement wherein said lever member comprises:

an external lever arm accessible for operation to pivot said lever arm forward; and an internal lever arm assembly connected to and movable with said external arm, including:

an extension structured and arranged to push said bolt body rearward only during an initial increment of forward pivoting movement of said external lever arm; and wherein said rack and pinion system comprises a floating rack element mounted to pivot with respect to said lever member and having means thereon structured and arranged to interact with means for moving said bolt body during a subsequent increment of forward pivoting movement of said external lever arm and to maintain rearward motion of said bolt body during any additional forward pivoting movement of said external lever arm.

2. An improvement according to claim 1 wherein said lever member and said floating rack element are independently pivotally mounted and including a biasing means operable to urge said floating rack element to pivot in a selected direction with respect to said lever member.

3. An improvement according to claim 2 wherein said lever member and said floating rack element are mounted on a common pivot axis, said lever member includes a first reaction element, said floating rack element includes a second reaction element, and said biasing means comprises a spring element positioned to be compressed between said first and second reaction elements when said external lever arm is pivoted forward.

4. An improvement according to claim 3 including a pinion gear mounted on an axle approximately parallel said pivot axis, with a first stage constructed and arranged to engage a rack surface carried by said floating rack element and a second stage constructed and arranged to engage a rack surface carried by said bolt body.

5. An improvement according to claim 1 including a biasing means associated with said lever member and said rack element constructed and arranged to permit said internal lever arm assembly to move independent of said rack element, thereby storing energy in said biasing means until said biasing means is capable of overcoming inertia of said rack element and said bolt body.

6. An improvement according to claim 5 wherein said lever member and said floating rack element are independently pivotally mounted and said biasing means is operable to urge said floating rack element to pivot in a selected direction with respect to said lever member.

7. An improvement according to claim 6 wherein said lever member and said floating rack element are mounted on a common pivot axis, said lever member includes a first reaction element, said floating rack element includes a second reaction element, and said biasing means comprises a spring element positioned to be compressed between said first and second reaction elements when said external lever arm is pivoted forward.

8. An improvement according to claim 7 including a pinion gear mounted on an axle approximately parallel said pivot axis, with a first stage constructed and arranged to engage a rack surface carried by said floating rack element and a second stage constructed and arranged to engage a rack surface carried by said bolt body.

* * * * *